US007236257B2

(12) United States Patent
Rubach

(10) Patent No.: US 7,236,257 B2
(45) Date of Patent: Jun. 26, 2007

(54) JUMP TAKEOFF POSITION INDICATOR SYSTEM

(76) Inventor: James E. Rubach, 4736 Fairway Dr., Waterford, WI (US) 53185

( * ) Notice: Subject to any disclaimer, the term of this patent is extended or adjusted under 35 U.S.C. 154(b) by 0 days.

(21) Appl. No.: 10/789,146

(22) Filed: Feb. 28, 2004

(65) Prior Publication Data

US 2005/0190379 A1 Sep. 1, 2005

(51) Int. Cl.
*G01B 11/14* (2006.01)
*G01J 5/00* (2006.01)
*G63B 21/00* (2006.01)

(52) U.S. Cl. ..... 356/614; 250/336.1; 250/349; 482/3

(58) Field of Classification Search ..... 356/614, 356/3.16, 4.06; 382/106, 2, 4–5; 482/8, 482/15, 27; 250/349, 223 R; 430/323 R, 430/555; 368/10, 110
See application file for complete search history.

(56) References Cited

U.S. PATENT DOCUMENTS 4,004,800 A 1/1977 Hanner
4,089,057 A * 5/1978 Eriksson ..... 702/158
4,099,713 A * 7/1978 Spector ..... 482/3
4,168,061 A * 9/1979 Gordon ..... 482/8
4,774,679 A * 9/1988 Carlin ..... 702/41
5,025,476 A * 6/1991 Gould et al. ..... 382/115
5,077,477 A * 12/1991 Stroman et al. ..... 250/349
5,294,912 A 3/1994 Bednarz et al.
5,625,191 A * 4/1997 Nakamura et al. ..... 250/363.04
5,753,931 A * 5/1998 Borchers et al. ..... 250/559.22
6,135,921 A * 10/2000 Holland et al. ..... 482/15
6,167,356 A * 12/2000 Squadron et al. ..... 702/166
6,181,647 B1 * 1/2001 Tipton et al. ..... 368/10
6,782,118 B2 * 8/2004 Verga ..... 382/106
2004/0259689 A1 * 12/2004 Wilkins et al. ..... 482/8

FOREIGN PATENT DOCUMENTS

DE 4030507 A1 * 4/1992
DE 4416844 A1 * 11/1995
WO WO 00/73735 A1 * 5/1999

* cited by examiner

*Primary Examiner*—Sang H. Nguyen
(74) *Attorney, Agent, or Firm*—Patents pemed, Inc; Atty Richard S. Missimer

(57) ABSTRACT

A jump takeoff position indicator system that discloses the point of takeoff of a long jump or triple jump in athletic competition or practice when an athlete's foot comes in contact with a takeoff board when beginning a jump. A plurality of light beams are emitted parallel to the edge of the takeoff board. The light beams are closely spaced, parallel to each other, and transverse to the direction of the jump. The foot position is known by the location of the beams broken at takeoff. A light beam detector detects interruption of the light beams by an athlete's foot and displays the takeoff position on a plurality of visible LEDs. The system provides a memory for storing the takeoff position and recall switch for retrieving and displaying the information after completion of the jump. The system is immune from ambient light disturbances and can easily be moved between multiple takeoff board locations. Microcontrollers are employed in a modular fashion for system control. Furthermore, the system is battery operated with low battery detection provided.

7 Claims, 13 Drawing Sheets

JUMP TAKEOFF POSITION INDICATOR SYSTEM

CROSS-REFERENCE TO RELATED APPLICATIONS

Not Applicable

STATEMENT REGARDING FEDERALLY SPONSORED RESEARCH

Not Applicable

REFERENCE TO SEQUENCE LISTING

Not Applicable

BACKGROUND OF THE INVENTION

This invention relates generally to Track & Field equipment and particularly to a jump takeoff position indicator system for use in events requiring an accurate indication of the foot position of an athlete at takeoff such as in the long jump and triple jump competitions.

The long jump and triple jump events in Track & Field competition require the athlete to jump from a fixed takeoff board into a sand filled landing pit from a running start down an approach runway. The takeoff board may be an actual wood or composition board or simply a painted area on the approach runway. Typical long jump runways have 2 takeoff boards at different distances from the sand pit to accommodate athletes of different jumping ability. The triple jump runway may have 3 or 4 different takeoff boards. The object of the competition is to attain the longest jump from the takeoff board. The distance of the jump is measured from the edge of the takeoff board closest to the sand pit to the point of first contact of the athlete in the landing pit.

Therefore, to gain the maximum measurable distance, the athlete attempts to takeoff as close to the edge of the board as possible without the front edge of the foot extending over. The jump is not measured if the front of the athlete's foot crosses over the edge of the takeoff board. The athletes that can takeoff close to the edge of the board have a definite advantage in the competition. Thus, training for these events involves repetitive approach runs to obtain consistency in the takeoff point. However, it is difficult for the athlete to know where their foot was in relation to the edge of the takeoff board during these practice sessions while running at full speed and concentrating on the other aspects of the jump. This often results in a coach or second athlete being needed to watch for the takeoff point. This results in approximate takeoff positions at best as human error comes into play. Clearly, a need exists for a device that provides long jump and triple jump athletes with this takeoff position information.

Several attempts have been made in the past to allow an athlete to determine where their foot was in relation to the board edge at the moment of takeoff. U.S. Pat. No. 4,004,800 to Hanner proposes a mechanical marker board that gives an indication of the foot position by means of an array of parallel mounted elements pivotally mounted to a base. Prior to use the elements are facing in an upward position. When a jump is made, the elements that come in contact with the athlete's foot are forced to lie flat, thereby, giving an indication of the takeoff point. Several problems exist with this approach. The mechanical marker board needs to replace the existing takeoff board and become a permanent part of the runway. With up to 6 different takeoff boards needed for the long jump and triple jump runways, it would be very costly to replace them all with the mechanical marker board. The marker board also presents a safety problem for the athlete as the foot is required to come in contact with movable elements. A third problem involves the mechanical nature of the device. With the location outdoors in close proximity to sand, the device would be a constant maintenance problem.

U.S. Pat. No. 5,294,912 to Bednarz et al. discloses a laser beam foul detector system used for detecting that an athlete's foot has crossed the foul line during a jump. A training beam option is described that gives an indication to an athlete that their foot crossed a line located in front of the foul line. However, this system fails to provide the accuracy required by today's athletes. It simply shows that a reference point was crossed. The margin of error could be as much as the length of the athlete's foot depending on the location of the training line relative to the foul line. The athlete may not cross the line at all resulting in no takeoff position information feedback. This system also suffers from a very involved alignment and setup procedure utilizing mounting plates and adjustment screws. Furthermore, the system lacks the portability required to move from location to location quickly as required when athletes are jumping from different takeoff boards. The system requires extensive installation that would be needed at each possible takeoff board location.

Accordingly, several objects and advantages of my invention are:

a) To provide a takeoff position indicator that is portable and can be moved from one takeoff board location to another quickly.
b) To provide an accurate indication of the foot position of an athlete at takeoff relative to the edge of the takeoff board.
c) To provide a system that can be used on existing approach runways without installation or modification of the approach runway.
d) To provide a system with a memory that stores the foot position information at takeoff for subsequent recall.
e) To provide a system that requires only visual alignment and no setup.
f) To provide a system that gives the athlete the means to determine their true jumping potential.
g) To provide a training device that allows the athlete to train without the aid of a coach or additional athlete.
h) To provide a modular system design that allows for easy system flexibility and expandability.
i) To provide a system that functions under all ambient light levels without adjustment.

Other objects and advantages of my invention will become clear to those skilled in the art after review of the following drawings and description.

BRIEF SUMMARY OF THE INVENTION

This invention provides a jump takeoff position indicator system utilizing an emitting or emitter device containing a plurality of light beam emitting devices, preferably IR(infrared) LEDs(light emitting diodes) combined with a detecting or detector device containing a plurality of corresponding light beam sensors or detectors. The combination when properly aligned using system alignment marks, provides a parallel light beam array that creates a foot detection zone over the takeoff board. A collimating device is provided in both emitting and detecting devices to create a narrow beam detection diameter. The IR LEDs are turned on one at a time sequentially from one end of the emitting device to the opposite end. The beam emission of the IR LEDs is synchronized with the detection by the light beam sensors. The synchronization is provided by an IR LED located at each end of the emitter device in combination with a sensor at each end of the detector device.

The detecting device contains a plurality of visible LED indicators for displaying the takeoff position. Each light beam detector is paired with an LED indicator. The detecting device also contains a memory for storing the status of the light beams during the scanning cycle along with a recall switch for retrieving the light beam status from memory and displaying the status on the LED indicators. The scanning cycle is fast enough such that each IR LED is turned on multiple times while an athlete's foot is in contact with the takeoff board. By locating the IR LEDs and light beam sensors on closely spaced predetermined centers a detection zone is created, which, when interrupted provides an accurate indication of the jumper's takeoff point. The battery powered system is portable and can be used with any existing takeoff board.

The emitting and detecting devices are placed on the approach runway on opposite sides of the takeoff board and aligned with the leading or trailing edge of the board. When an athlete's foot makes contact with the takeoff board during a jump, one or more beams are broken. The detecting device detects the beams interruption, illuminates corresponding LED indicators, and stores the information for subsequent recall. The LED indicators are turned OFF to conserve battery power after a short time delay. When the recall switch is pressed, the stored position information is displayed on the LED indicators for several seconds. This feature allows the athlete to complete their jump and take as much time as needed to exit the landing pit and not loose the jump's takeoff position information. After the recall time delay, the system returns to scanning for the next jump and deletes the previous information from memory.

With the invention an athlete can determine his takeoff position without the use of a coach or another athlete. After completing a practice jump, the athlete simply presses the recall switch to see exactly where the takeoff point was. Therefore, the invention allows the athlete to determine their actual jumping potential, as the distance measurement can be taken from the takeoff point indicated by the system. The system provides multiple alignment marks for athletes of different abilities. Under normal conditions the system is placed such that the detection zone is directly over the takeoff board. However, for athletes that are having problems with the approach, the system can also be placed in front of or past the takeoff board by utilizing the proper alignment marks.

By utilizing wide angle beam emitters and detectors, along with collimating emitting and detecting apertures, a system is provided that does not require an accurate setup or alignment procedure but yet functions under all lighting conditions without adjustment. The number of beams used in a system is determined by the desired detection zone as well as the desired spacing between sensors. The system can easily be moved between takeoff boards without any modification of the approach runway or complicated setup procedure.

The invention also provides a low battery detection and indication system. The batteries are easily removed and recharged or replaced.

BRIEF DESCRIPTION OF THE SEVERAL VIEWS OF THE DRAWINGS

The takeoff position indicator system may be best understood by those having ordinary skill in the art by reference to the following detailed description when considered in conjunction with the accompanying drawings in which.

DETAILED DESCRIPTION OF THE INVENTION

Figure 1:
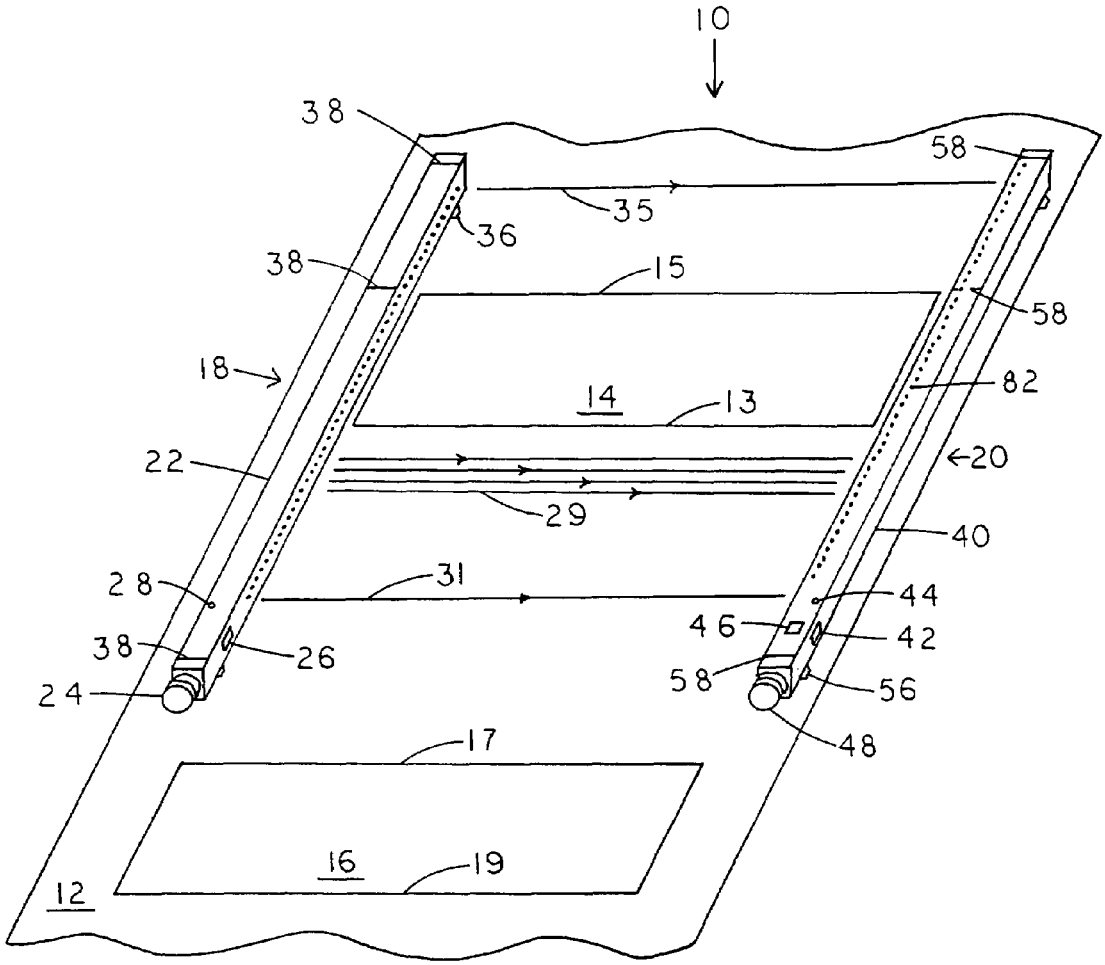
FIG. 1 is a perspective view of the jump takeoff position indicator system as it would be located on a typical approach runway.

Throughout the following detailed description, the same reference numerals refer to the same elements in all figures. In addition, the terms microcontroller, CPU and processor are used interchangeably.

FIG. 1 illustrates a perspective view of the jump takeoff position indicator system 10. Approach runway 12 is provided with main takeoff board 14 and auxiliary board 16 for the athlete to jump from.

Emitting device 18 and detecting device 20 are placed on runway 12 on opposite sides of main takeoff board 14 with alignment marks 38 and 58 placed over foul line 15 or board leading edge 13. If auxiliary takeoff board 16 is used, the emitting and detecting devices are placed on opposite sides of auxiliary board 16 with alignment marks 38 and 58 placed directly above foul line 17 or board leading edge 19. Multiple alignment marks 38 and 58 are provided for setting up a detection zone in front of the takeoff board, on the takeoff board, or past the takeoff board.

As shown in FIG. 1, emitter device 18 emits multiple infrared (1R) light beams 29 that are detected by detector device 20. The IR beams 29 are not all ON at the same time, but rather, they are sequenced ON one at a time. As also shown in FIG. 1, IR sync #1 beam 31 and IR sync #2 beam 35 are emitted from emitter 18 to synchronize the emitter with the detector and initiate the sequencing of the IR beams 29. While only 1 sync beam is needed for system operation, 2 are provided at opposite ends to allow for continued detection in the event that 1 of the sync beams is broken by an athlete's foot. Enclosure 22 houses and protects the emitter electronics. LED indicator 28 is provided for low battery indication. Removable battery 24 supplies power for the unit. ON/OFF switch 26 turns the emitter device 18, ON and OFF. The device is supported by mounting pads 36.

As shown in FIG. 1, detector device 20 detects multiple infrared light beams 29 emitted by emitter 18. Enclosure 40 protects the detector electronics. LED indicator 44 is provided for low battery indication. Removable rechargeable battery 48 powers the unit. ON/OFF switch 42 turns the detector device 20, ON and OFF. Detector 20 is supported by mounting pads 56.

Figure 5:
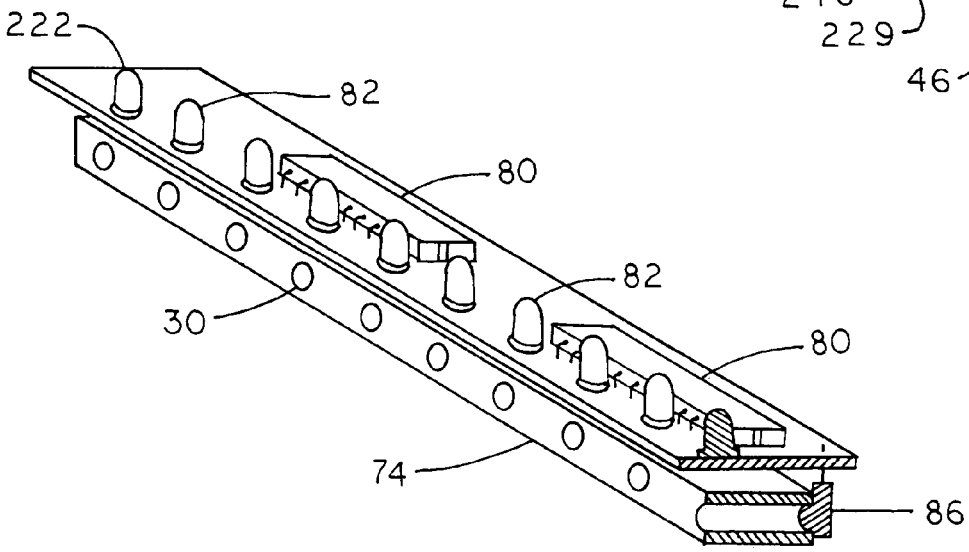
FIG. 5 is an enlarged section view of the detector electronic assembly.

As also shown in FIG. 1 and FIG. 5, recall switch 46 is provided for recall and display of the takeoff foot position on LED indicators 82.

Figure 2:
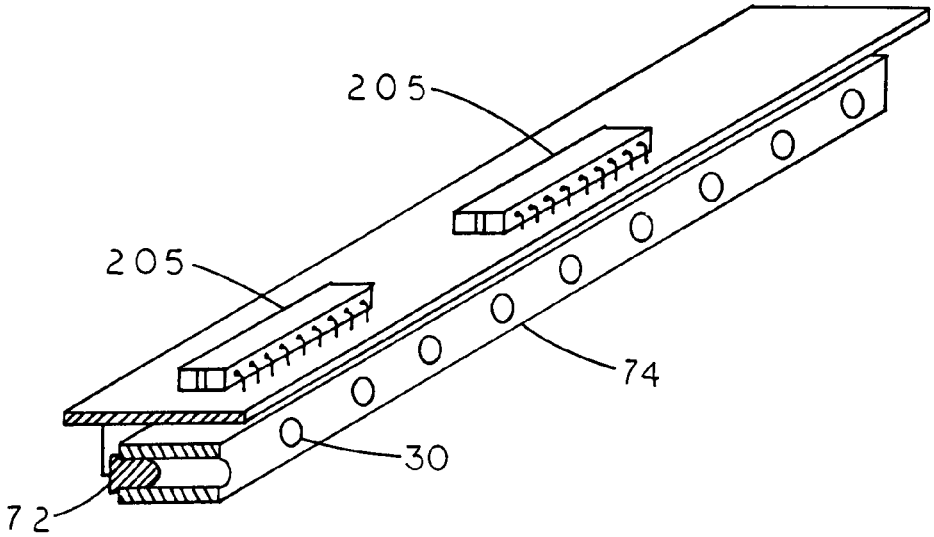
FIG. 2 is an enlarged section view of an emitter electronic assembly.
Figure 3:
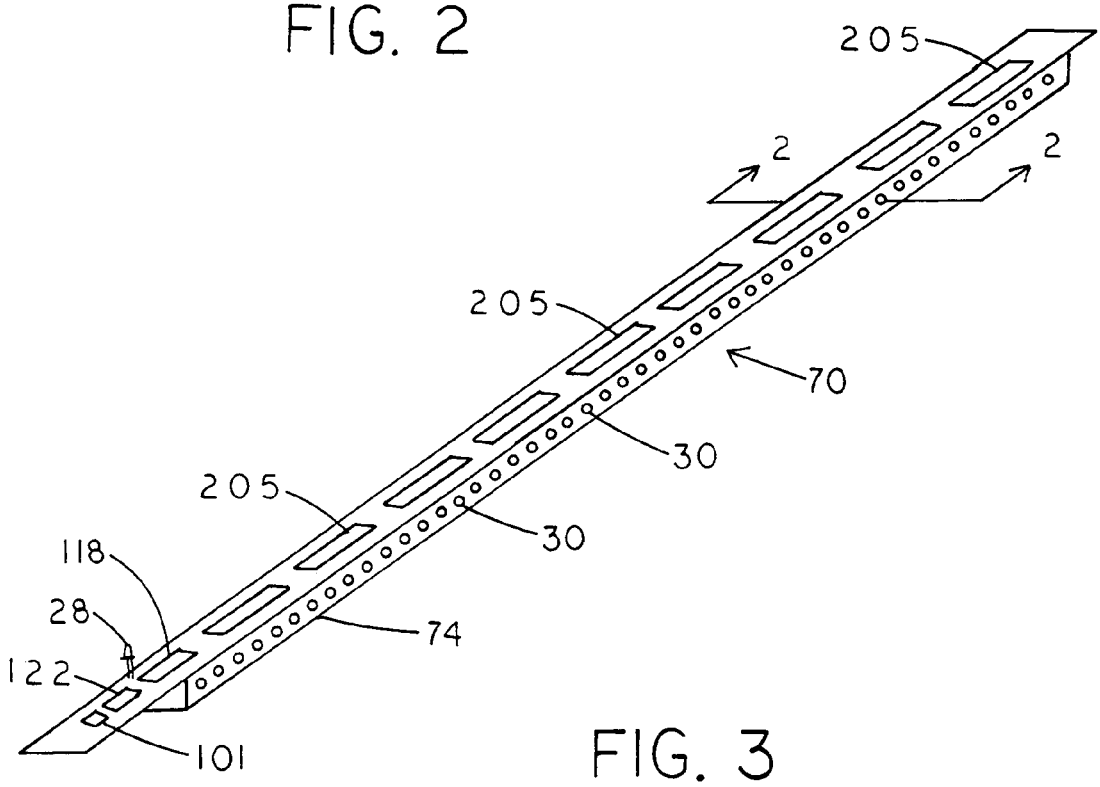
FIG. 3 is a perspective view of the emitter electronic assembly.

FIG. 3 shows a perspective view of emitter electronic assembly 70. FIG. 2 is an enlarged section view of assembly 70. Assembly 70 is comprised of multiple IR LEDs 72, along with remaining control circuitry. As shown in FIG. 2, mounting block 74 contains multiple apertures 30. One IR LED 72 is located at the back edge of each aperture 30. The aperture collimates the light beam emission from IR LED 72. The apertures are spaced at a distance determined by the desired detection zone of the system. Typical spacing distances are 1 cm, 0.5 in., and 1.0 in. These dimensions are given by way of example and not by way of limitation. The diameter of aperture 30 determines the beam diameter that is sensed by detector device 20. A diameter equal to the diameter of the IR LED has been found to work well. While an aperture collimating method is described, other collimating means such as lenses or reflectors could also be used. Electronic assembly 70 is mounted in a suitable enclosure along with battery 24 and ON/OFF switch 26.

Figure 4:
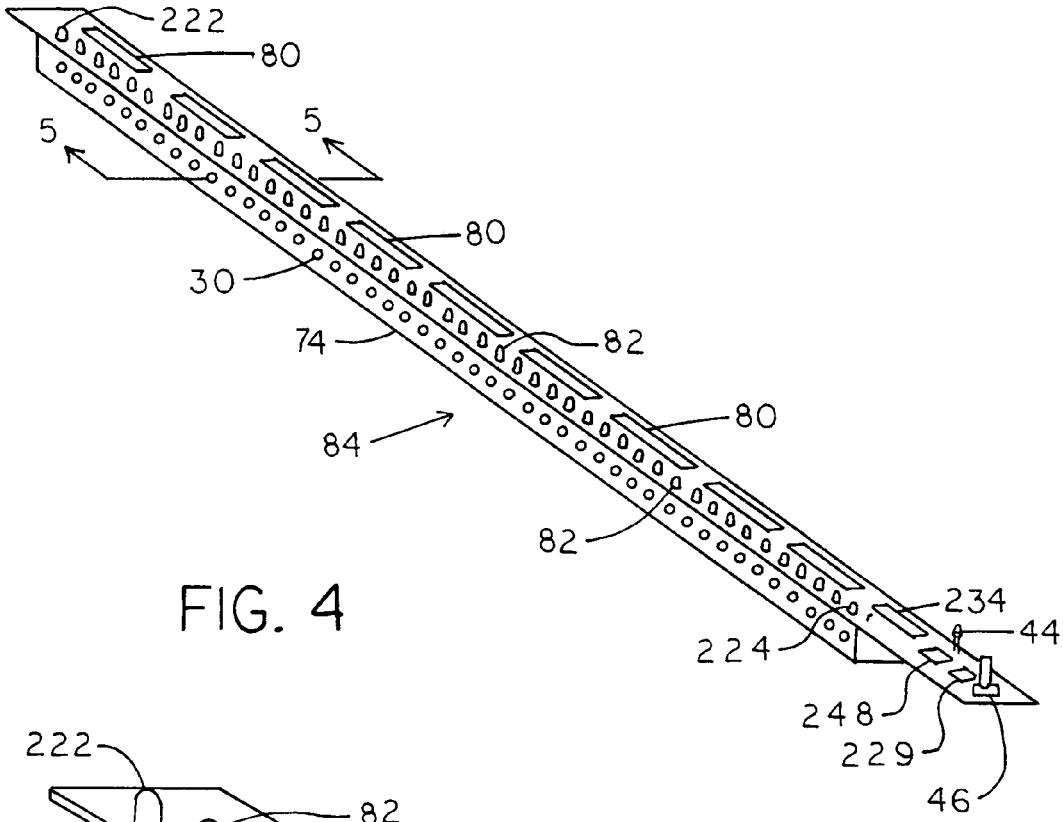
FIG. 4 is a perspective view of a detector electronic assembly.

FIG. 4 shows a perspective view of detector electronic assembly 84. FIG. 5 is an enlarged section view of assembly 84. Assembly 84 is comprised of multiple IR sensors 86, multiple LED indicators 82 along with remaining control circuitry. As shown in FIG. 4 and FIG. 5, mounting block 88 contains multiple apertures 30 with sensors 86 located at the back edge of each aperture. By locating the sensor behind each aperture, immunity from ambient light disturbances common in an outdoor environment is provided. The IR sensors used in the detector device are sensitive to a specific carrier frequency. Commercial sensors are available with carrier frequencies in the range of 37-57 kHz. A 38 kHz carrier frequency was chosen for the invention herein disclosed. However, other frequencies could also be used. Each sensor 86 is paired with an LED indicator 82. When infrared beam 29 is broken by an athlete's foot, sensor 86 detects the break and a corresponding indicator 82 is illuminated. The detection and indication process is further described elsewhere in this specification. The diameter of aperture 30 determines the beam diameter that will be detected by sensor 86. The aperture collimates the sensors beam detection angle. This feature provides the accuracy required as the actual beam detection angle of sensor 86 is much larger than the aperture diameter. This characteristic also eliminates precise alignment requirements by providing for small diameter beam detection within the larger detection cone of the sensor.

Figure 6A:
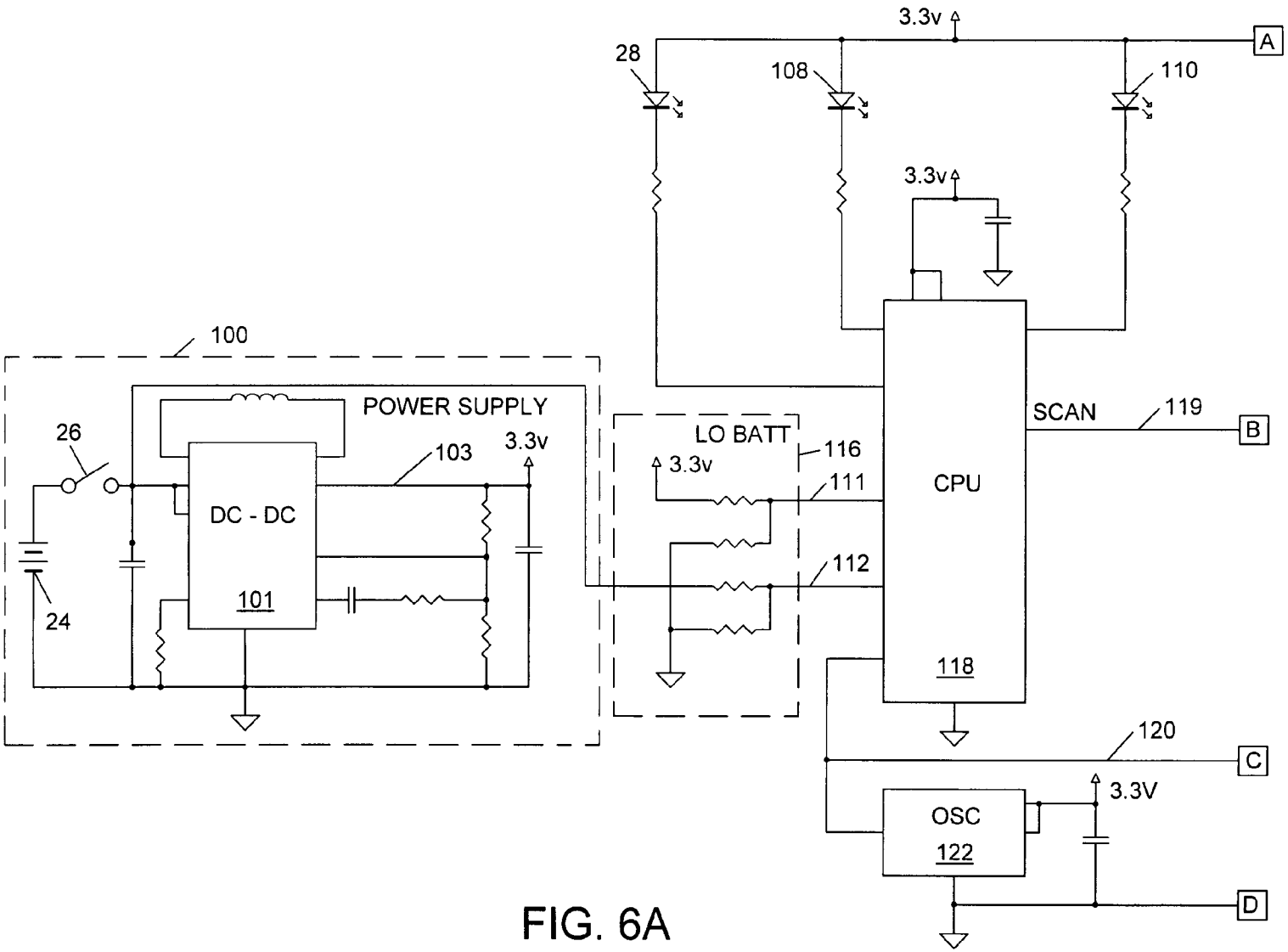
FIGS. 6A & 6B combined are a schematic diagram of the emitter device.
Figure 6B:
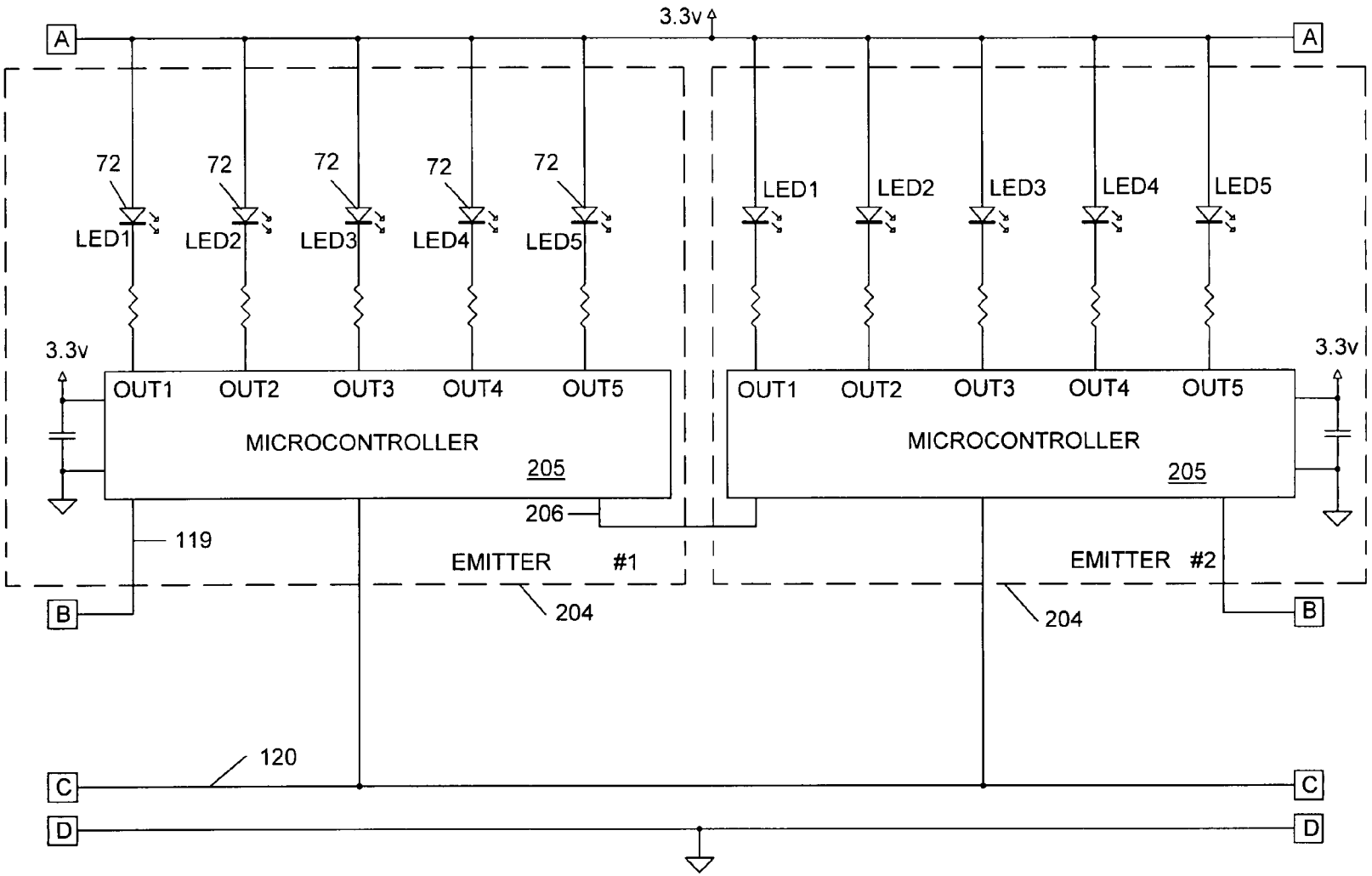

The schematic for the emitter device is shown in FIG. 6A and FIG. 6B. FIG. 6A shows the emitter device's power supply circuit 100 along with remaining control circuitry. Battery 24 is connected to On/Off switch 26 to supply power to a DC-DC converter 101. Converter 101 supplies a regulated output voltage of 3.3v at 103 over the useful battery input voltage range of 2.5v to 4.2v. Microcontroller or CPU 118 acts as the control processor for the emitter device. Scan line 119 triggers a first IR LED emitter microcontroller 205 of FIG. 6B. Lo battery indicator 28 is connected to CPU 118 along with IR LEDs 108 and 110. IR LEDs 108 and 110 are used to emit synchronization beams 31 and 35 as shown in FIG. 1. Oscillator 122 provides a master clock signal 120 for microcontroller 118 and also feeds emitter microcontrollers 205 as shown in FIG. 6B. Battery voltage is monitored by Lo battery detect circuit 116.

FIG. 6B is the IR LED control portion of the emitter schematic, showing 2 IR LED emitter circuits 204. Each circuit consists of microcontroller 205 and 5 IR LEDs 72. Two circuits are shown to indicate the interconnections required between the circuits. It is understood that the circuit would repeat equal to the number of remaining circuits in a complete emitter device. The number of IR LED emitter circuits in a complete emitter device will vary based on the desired length of the detection zone. The example shown in FIGS. 1-5 contains 9 such circuits. This modular approach results in a system that is easily expandable.

Figure 8:
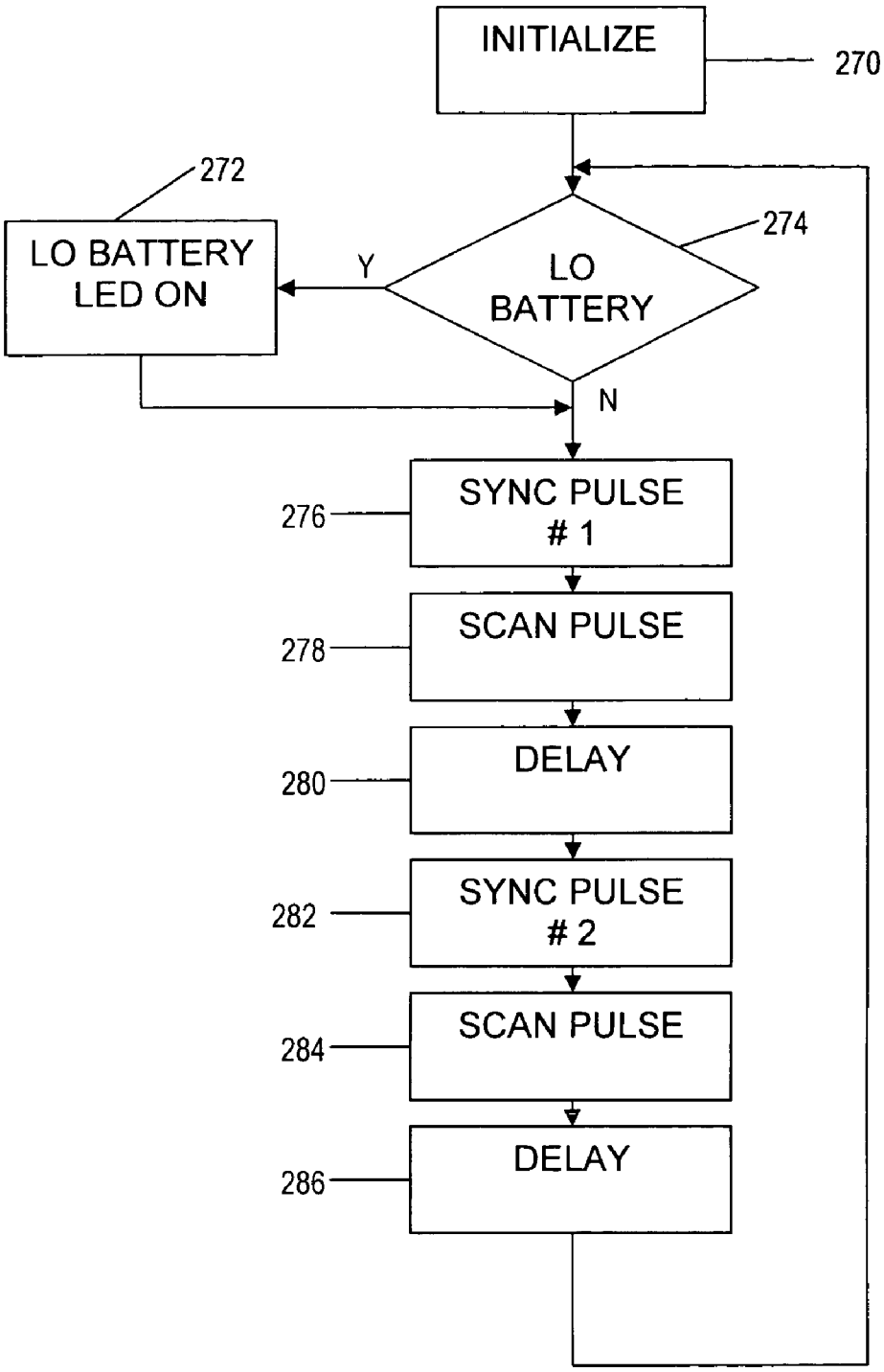
FIG. 8 is a flowchart of an emitter control processor program.
Figure 9:
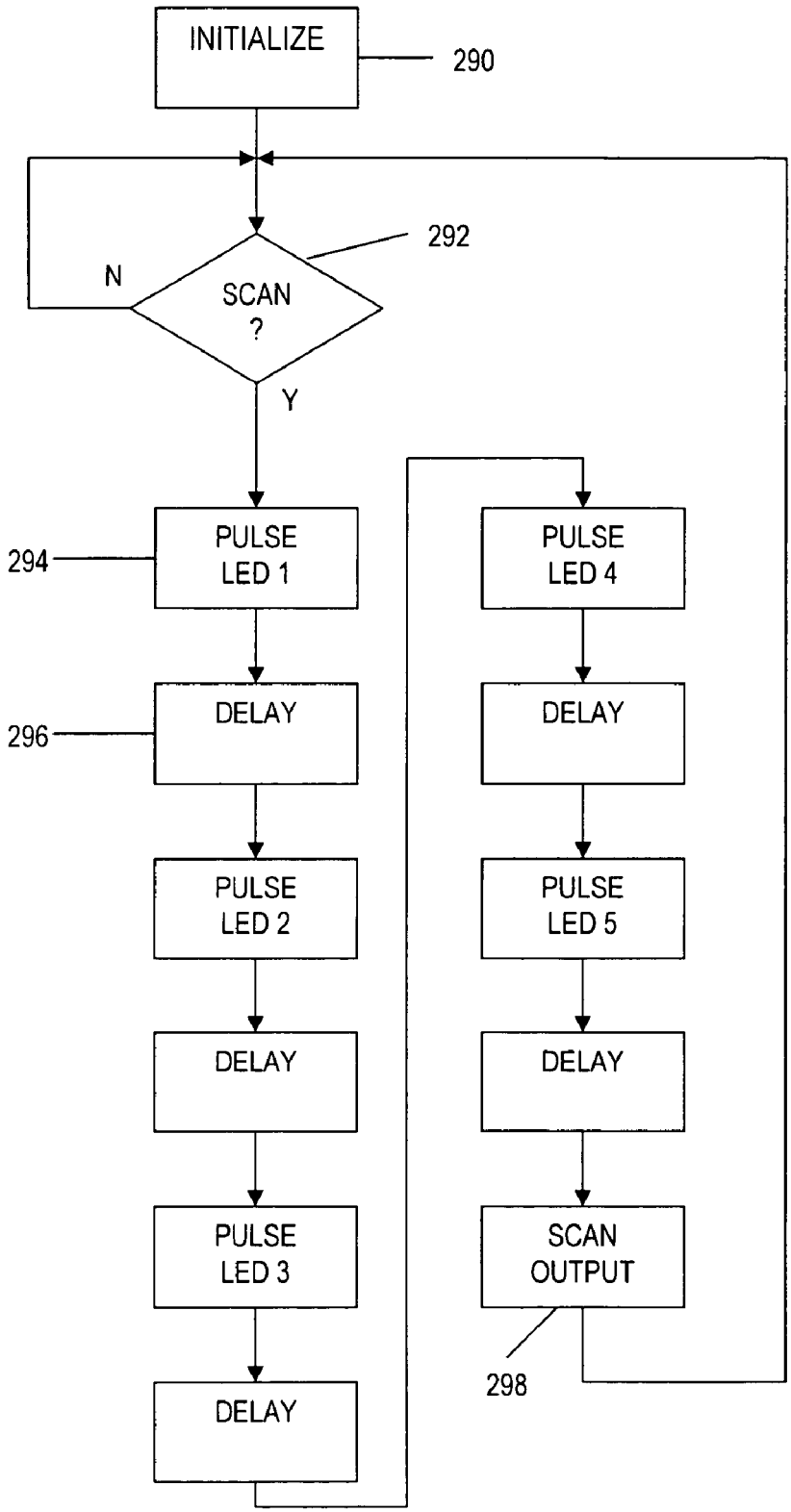
FIG. 9 is a flowchart of an emitter IR LED control processor program.
Figure 10:
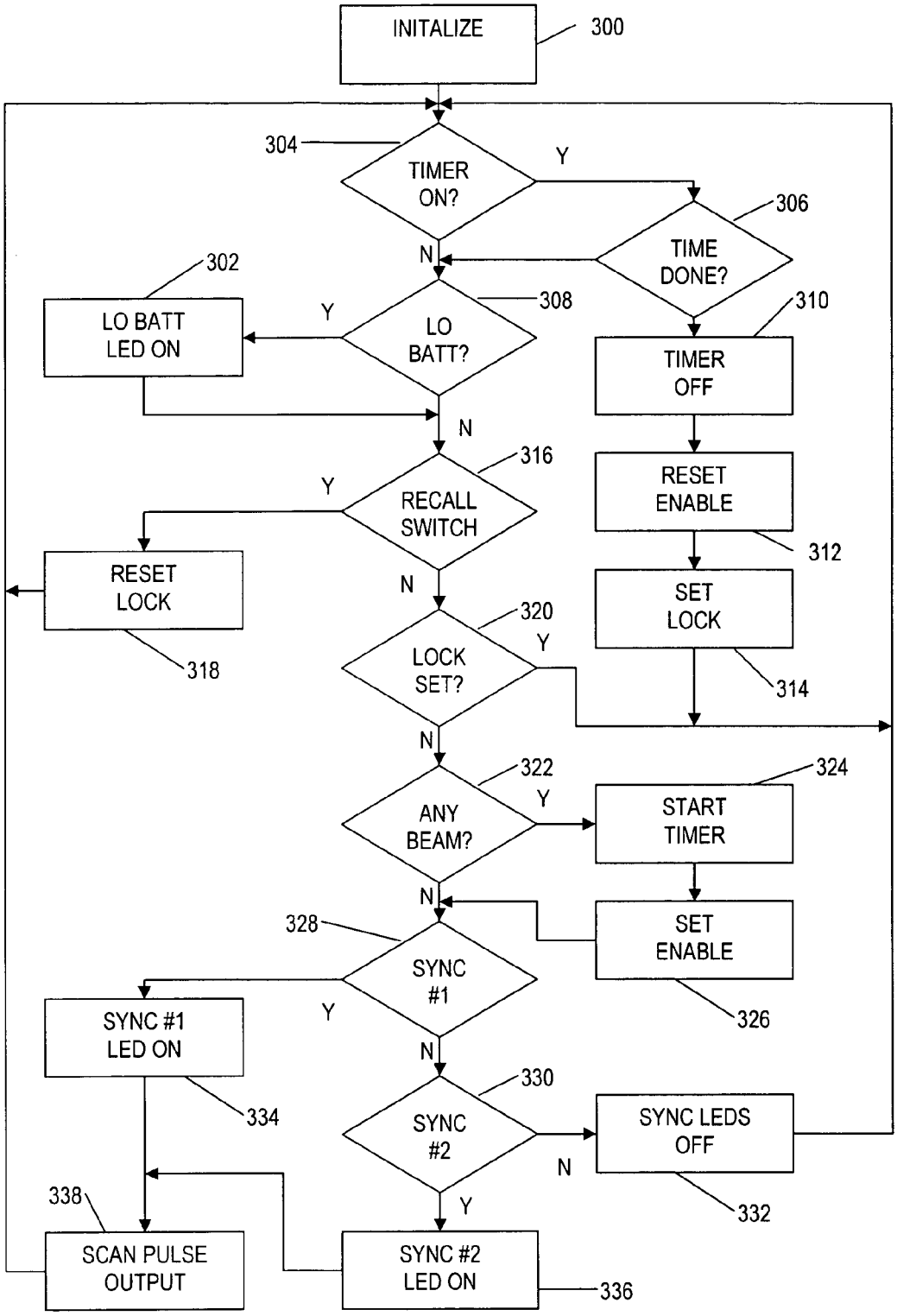
FIG. 10 is a flowchart of a detector control processor program.

Refer now to FIGS. 8 and 9 along with FIGS. 2, 3, 6A, 6B and 12 for an operational description of the emitter device's firmware that is burned into microcontrollers 118 and 205 permitting them to carry out their respective control functions.

Figure 12:
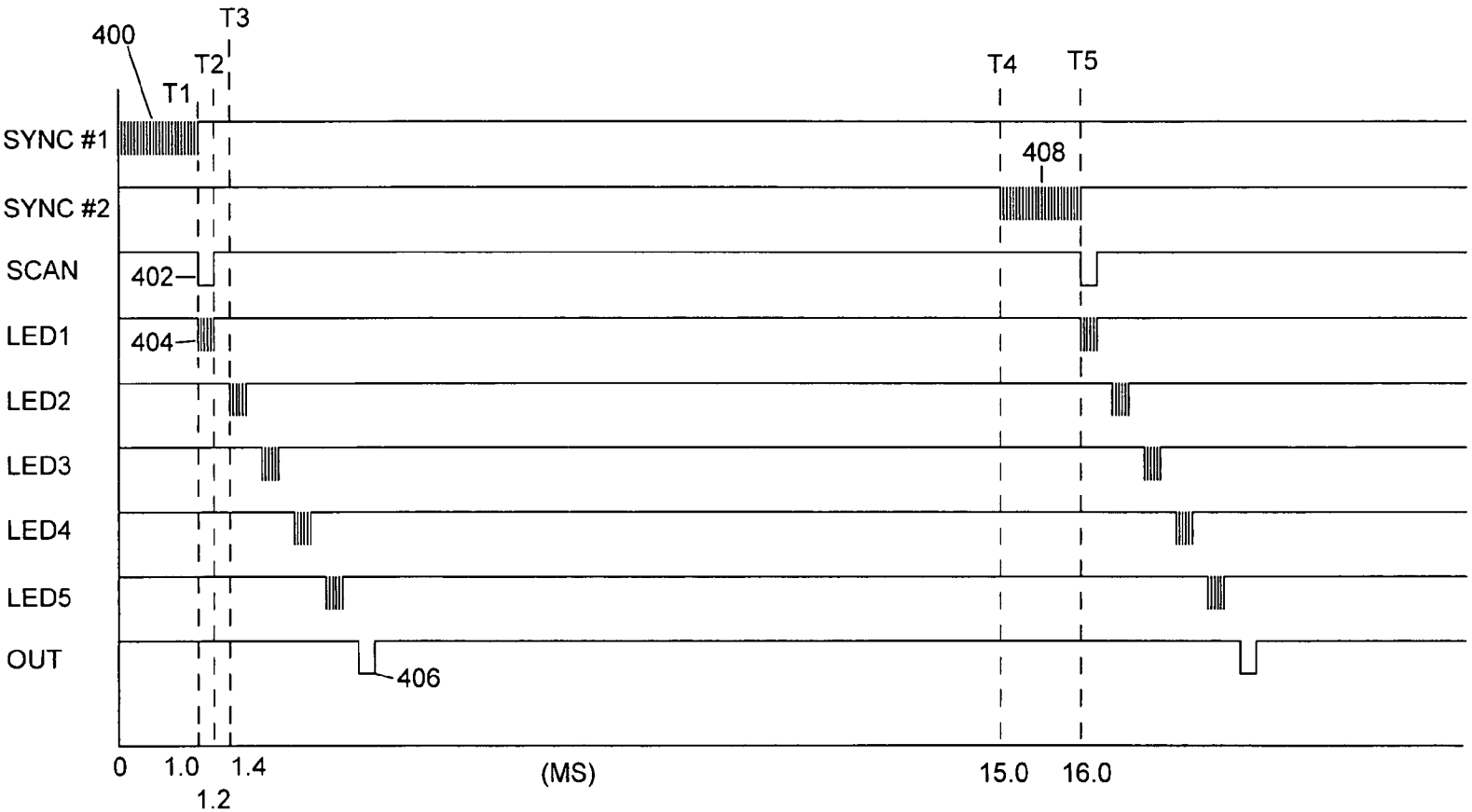
FIG. 12 is a timing sequence diagram of the emitter device.

The memory of microcontroller 118 is programmed according to the flow chart shown in FIG. 8. Upon power up, the microcontroller is initialized at 270, setting all registers and I/O lines to initial conditions. The controller then tests for battery status (274). Battery detect circuit 116 of FIG. 6A is used during this test. Battery voltage is compared via input signals 111 and 112 of FIG. 6A. If the battery voltage 112 is below reference voltage 111, the Lo battery indicator 28 is turned on (272). If the battery voltage is acceptable, IR sync pulse #1 is generated (276) by modulating IR LED 108 of FIG. 6A. Pulse 400 consists of a 1 ms burst at the chosen 38 kHz carrier frequency as shown in FIG. 12. Following the sync pulse, scan line 119 of FIG. 6A is activated. Scan pulse 402 as shown in FIG. 12 is output at step 278. This 200 microsecond pulse is used to signal the first IR LED emitter processor 205 of FIG. 6B to begin the scan of the IR LEDs 1-5. The control processor then delays (280) for about 14 ms. The process is repeated for sync pulse # 2. Pulse 408 as shown in FIG. 12 is generated at step 282 followed by a second scan pulse at 284 and a delay (286). The controller then returns to 274 to check the battery voltage and start the scanning process over again. This process is repeated on a continuous basis.

The memory of IR LED emitter microcontroller 205 of FIG. 6B is programmed in accordance with the flow chart shown in FIG. 9. After the initialization step (290), the program enters input detection mode 292. Microcontroller 205 continuously checks for a logic 0 level on scan input 119 of FIG. 6B. When a scan pulse is detected the program begins the sequential scanning of IR LEDs 72 starting with LED1 proceeding to LED5. LED pulse 404 as shown in FIG. 12 is turned on (294) followed by delay (296). FIG. 12 shows the timing diagram for the IR LED emitter microcontroller signals. IR LED signal 404 is modulated at the system carrier frequency of 38 kHz. The output frequency is selected to match the carrier frequency of the IR sensor used in detector device 20 of FIG. 1.

Remaining LEDs 2-5 are turned on in sequence followed by scan output pulse 406 of FIG. 12 on signal line 206 of FIG. 6B at step 298. Program control then returns to wait for another scan pulse at 292. The output scan line 206 feeds the next IR LED emitter microcontroller 205 in the system. Additional emitter circuits in the system utilize the same microcontroller program. This building block approach provides for flexible system design and expandability by using common components.

Figure 7A:
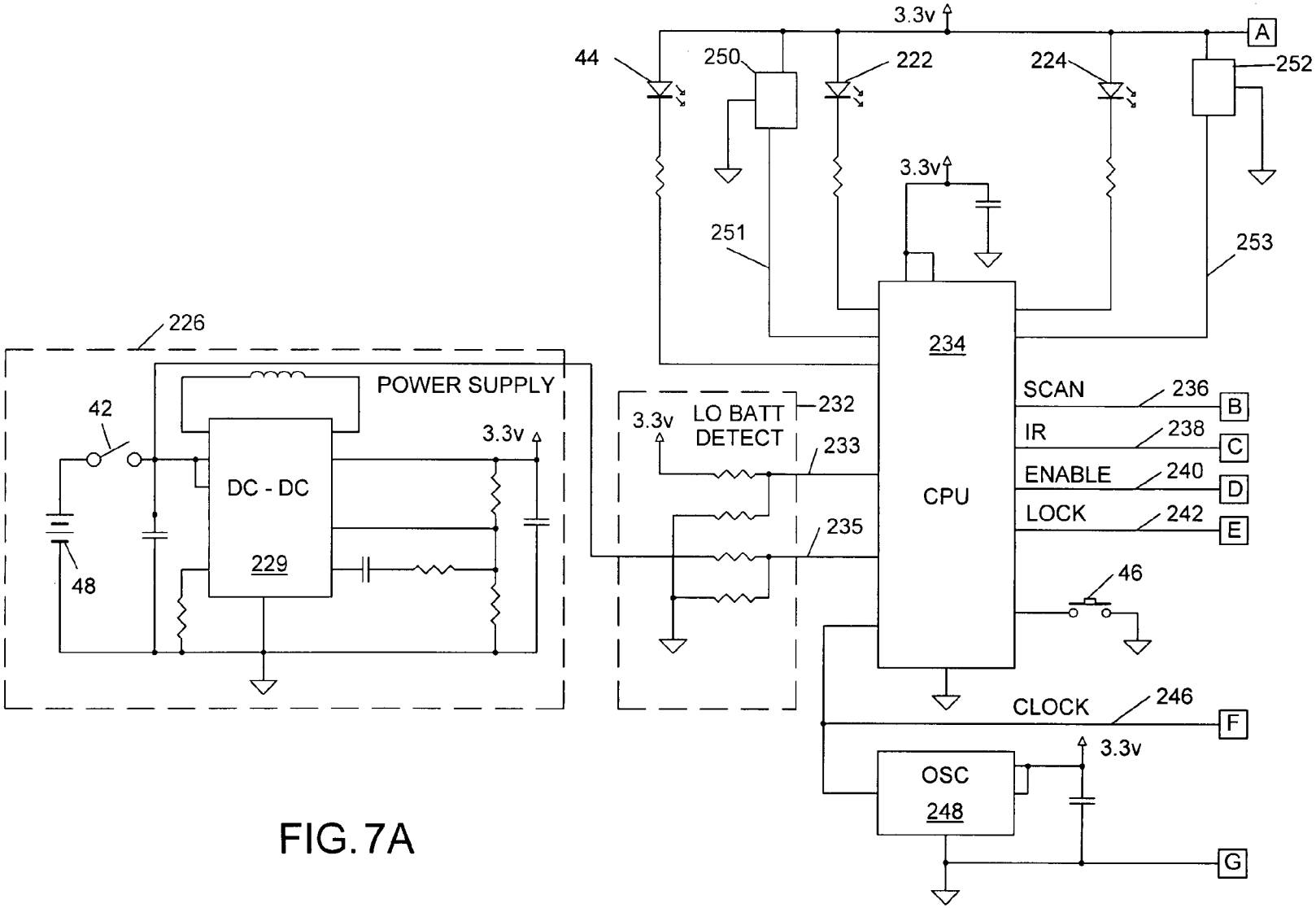
FIGS. 7A & 7B combined are a schematic diagram of the detector device.
Figure 7B:
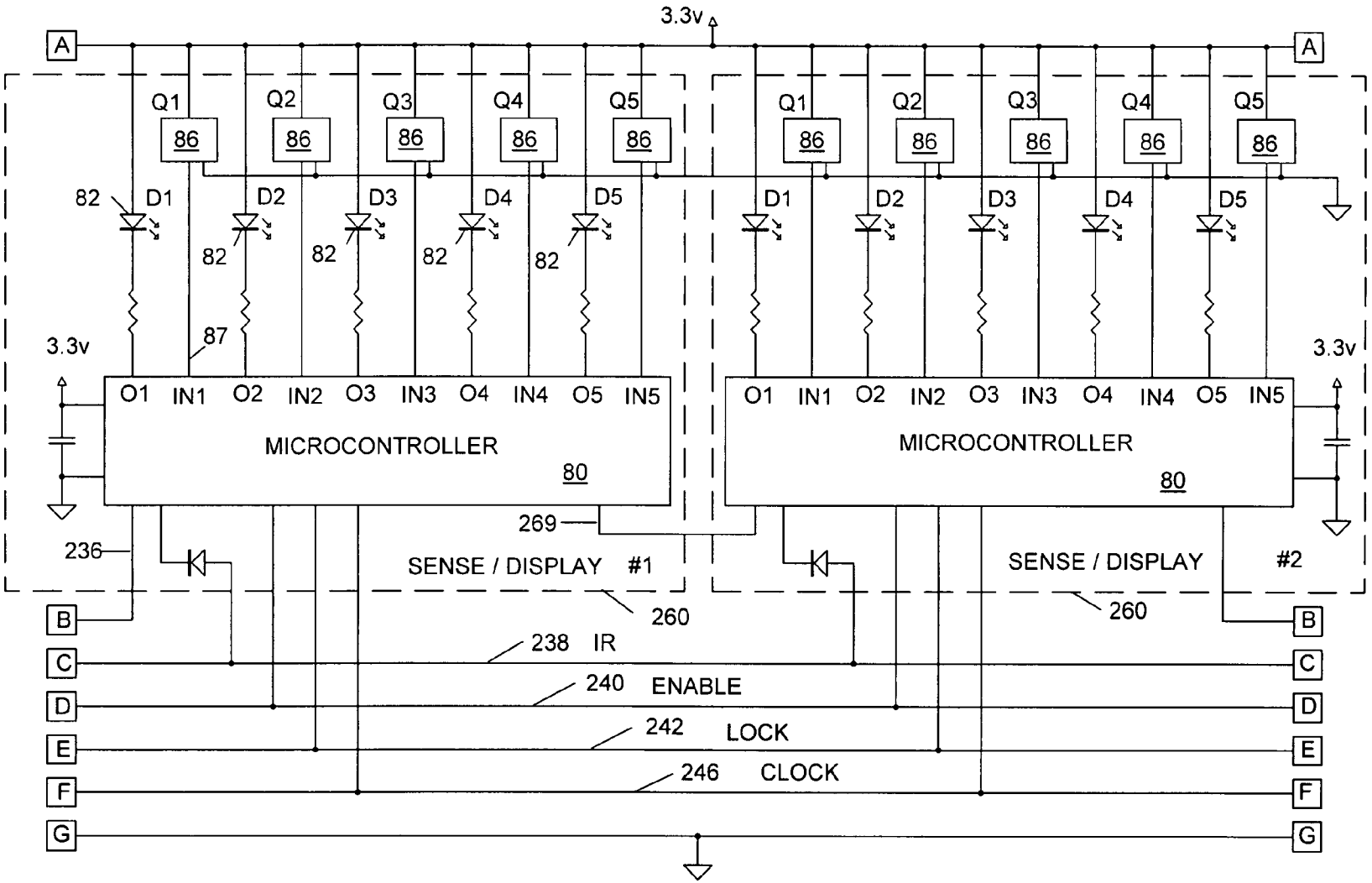

FIGS. 7A and 7B, together, comprise the schematic of detector device 20 shown in FIG. 1. Power supply circuit 226 provides regulated 3.3v over an input voltage range of 2.5v to 4.2v. Battery 48 connects to On/Off switch 42 which delivers power to DC-DC converter 229. Microcontroller 234 acts as the control processor for the detector device. Microcontroller 234 controls LED indicators 44, 222, and 224. IR sensors 250 and 252 also feed the controller. Oscillator 248 provides a master clock signal for microcontroller 234 at line 246 and also feeds sensor/display microcontrollers 80 shown in FIG. 7B. Recall switch 46 also inputs to microcontroller 234. Battery voltage is monitored by Lo battery detect circuit 232.

FIG. 7B is the sensor/display schematic, showing 2 sense/display circuits 260. Each circuit consists of microcontroller 80, 5 IR sensors 86 and 5 LED indicators 82. The number of sensor/display circuits in a detector device will vary based on the desired length of the detection zone. Two circuits are shown here to illustrate the connection requirements. It is understood that the circuit will repeat equal to the number of circuits required for a complete detecting device.

Please reference FIGS. 4, 5, 7A, 7B, and FIG. 10 for the following operational description. The memory of microcontroller 234 shown in FIGS. 4 and 7A is programmed according to the flowchart shown in FIG. 10. Upon power up, the microcontroller is initialized at 300, setting all registers and I/O lines to their initial conditions. The controller then enters the main control loop. An internal timer is used to control the display time of all LED indicators 82. The program first tests the status of the timer (304). If the timer is on, the program then checks to see if the time delay has expired (306). If the time has expired, the timer is turned off (310), enable line 240 of FIG. 7A is reset (312) and lock line 242 of FIG. 7A is set (314). The lock signal line 242 is an output that prevents IR sensor microcontrollers 80 from scanning the sensor inputs when set. Enable line 240 is an output that allows the IR sensor controllers 80 to turn on the appropriate LED indicator 82 when set.

Program control then returns to step 304 and again checks the status of the timer. If the timer was not off at 304 or the time had not expired at 306, control passes to step 308. Battery voltage is checked by lo battery detect circuit 232 of FIG. 7A. If the battery voltage on signal line 235 is below a reference voltage on line 233, step 302 turns on LED indicator 44. If battery voltage is above the threshold, the status of recall switch 46 is checked at step 316. If the recall switch is closed, step 318 resets lock signal 242 and control returns to 304. If recall switch 46 is open, step 320 then checks the status of the lock signal 242. If set, control returns to 304 and will continue to loop, waiting for the lock signal to be reset by recall switch 46. Program execution proceeds to step 322 if the lock signal is not set. The status of input signal 238 is checked at this point. This line is cleared by any IR sensor microcontroller 80 that has sensed a beam break. If any beam has been broken, the internal timer is started (324) and enable signal 240 is set at step 326. Execution continues at step 328. This step checks output signal 251 of sync #1 IR sensor 250 shown on FIG. 7A. If a valid sync pulse is detected, LED indicator 222 is turned on at 334, and a 200 microsecond scan pulse is output on signal line 236 of FIG. 7A at step 338. Control then returns to step 304. If sync pulse #1 is not present at step 328, step 330 checks for sync #2 pulse. This step checks output signal 253 of sync #2 IR sensor 252 of FIG. 7A. If a valid pulse is detected, LED indicator 224 of FIG. 7A is turned on at 336 and a scan pulse is again output on signal line 236 at step 338. Control again returns to step 304. If sync pulse #2 is not detected, LED indicators 222 and 224 are turned off (332), followed by a return to step 304.

Figure 11A:
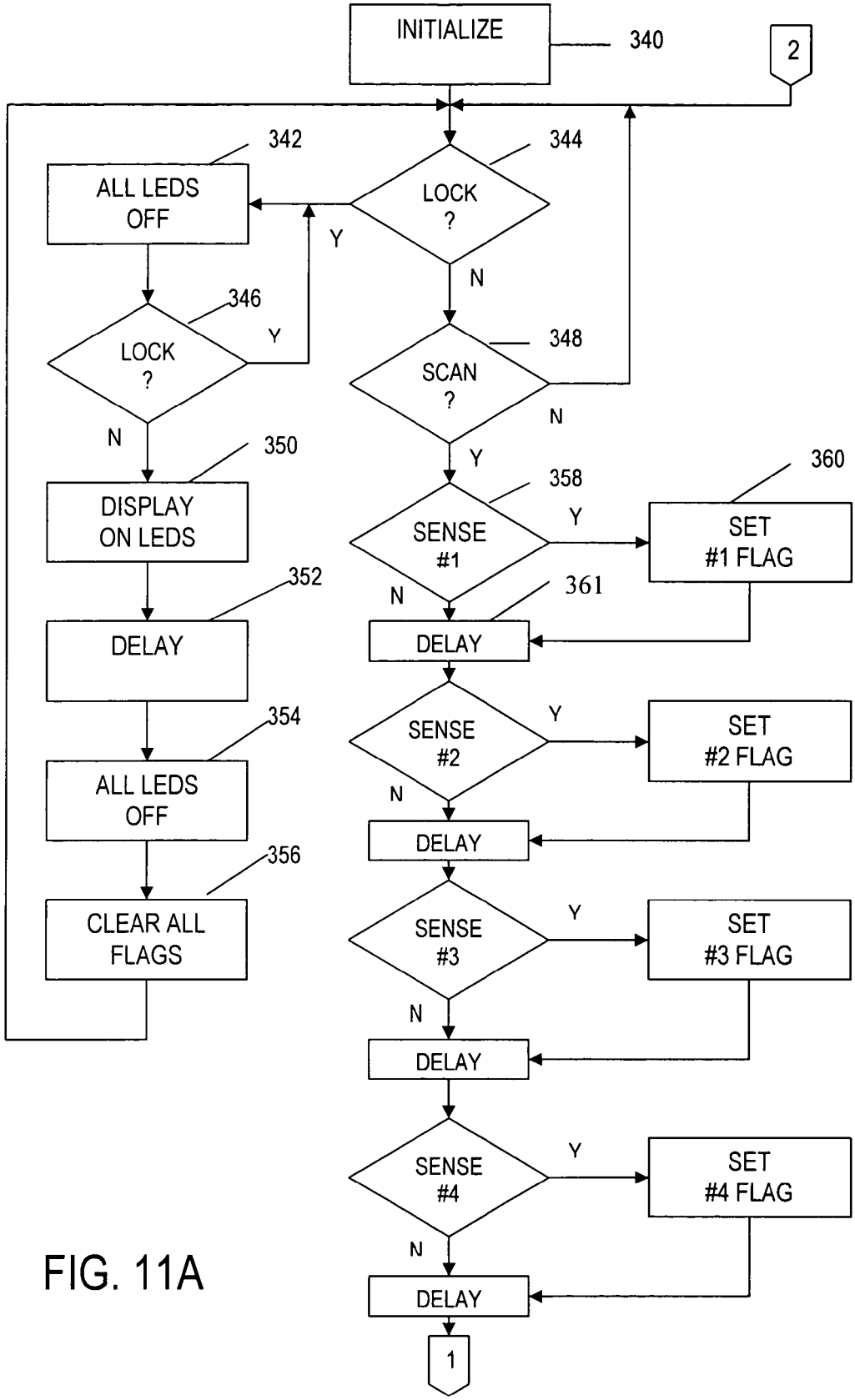
FIGS. 11A & 11B combined are a flowchart of a detectors' sensor/display processor program.
Figure 11B:
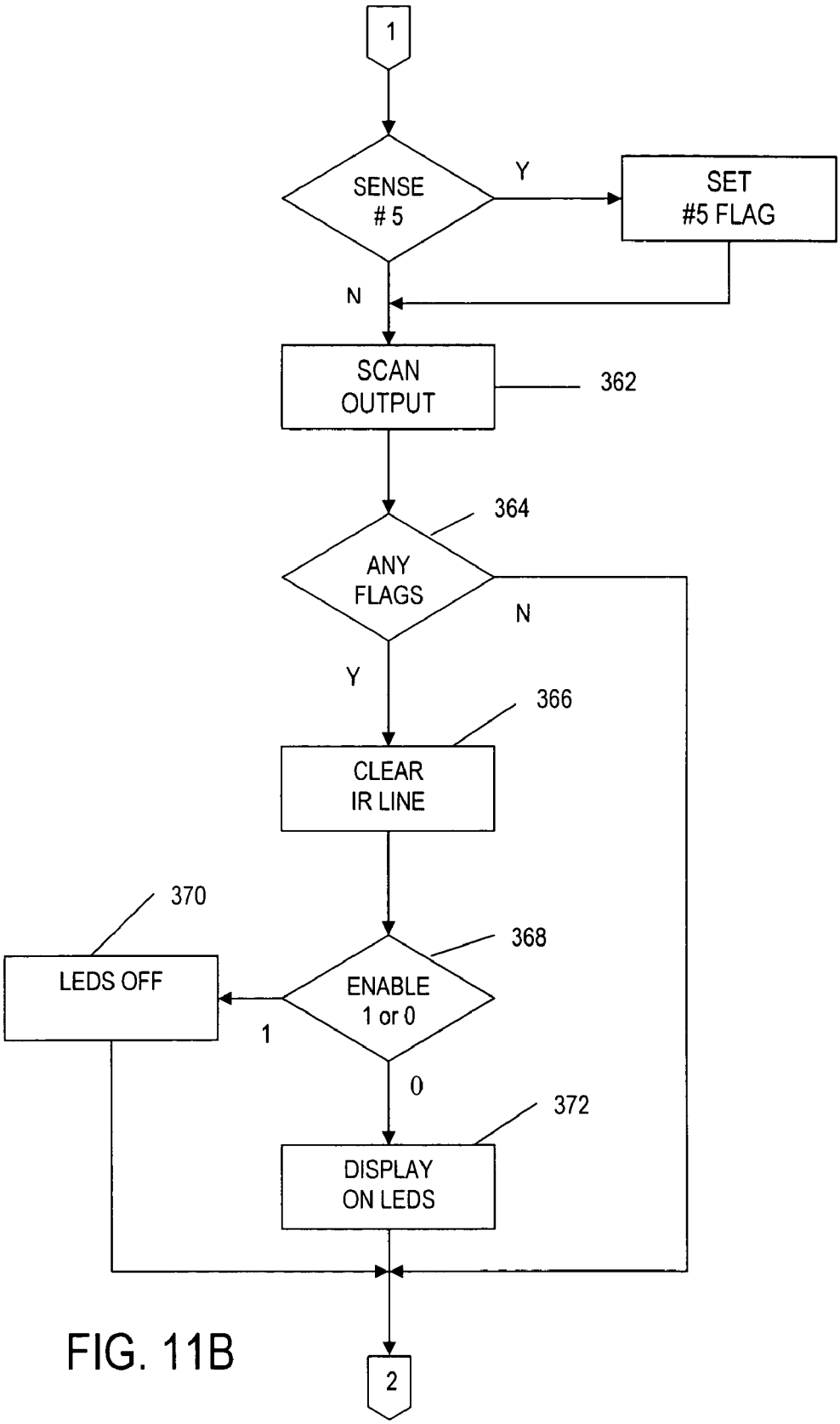

Refer now to FIGS. 7B, 11A and 11B to follow the detailed operational description of the IR sensor/display circuit 260 of FIG. 7B. The memory of microcontroller 80 is programmed according to the flowchart shown in FIGS. 11A and 11B. Upon initialization (340), all registers and I/O lines are configured and set to their appropriate initial conditions. All LED indicators 82 are turned off. The program then enters the main control loop starting at step 344. If lock input signal 242 is set, LED indicators are turned off (342) and the program will wait in a loop for lock signal 242 to be cleared. When the lock signal is cleared, execution continues at 350. A description of steps 350-356 will follow the description of the remainder of the flowchart.

If the lock signal is cleared at 344, step 348 waits for scan input signal 236 of FIG. 7B to go LO (0v). When a LO signal is detected, the scanning of IR sensors 86 begins starting with Q1. Q1 is tested at 358. The scanning of IR sensors 86 is synchronized with the IR beam emission of the emitter device as previously described. If the IR beam is not present, output line 87 of Q1 will be at logic 1 (3.3v) level. A logic 0 (0v) represents the presence of the 1R sense signal #1. If sense signal #1 (87) is 1, step 360 sets a flag in memory corresponding to Q1 sensor #1 (86). Following a delay at 361, sensors Q2-Q5 are tested in similar fashion, and corresponding flags set if required. After completing the sensor scanning, execution continues at step 362 of FIG. 11B with a scan output pulse on output line 269 as shown in FIG. 7B. This signal triggers microcontroller 80 of the next sense/display circuit in line to begin the scan of the corresponding IR sensors 86. If any flags have been set (364) as a result of the scan cycle, output line 238 is pulled LO (0v) at 366. This line is monitored by microcontroller 234 of FIG. 7A as previously described. Enable line 240 is tested (368). If LO (0v), LED indicators 82 (D1-D5) will be turned ON or OFF at step 372 based on the flag status resulting from the sensor scan. All LEDS are turned OFF at step 370 if enable line 240 is HI (3.3v). If no flags are set at 364, execution returns to step 344 of FIG. 11A.

Refer now to step 350 of FIG. 11A. When the lock signal has been cleared by the activation of recall switch 244 at step 346, LED indicators 82 (D1-D5) are turned ON or OFF based on the flag status resulting from the scan. Following a 4-5 second delay (352), all LEDs are turned OFF (354), all flags are cleared (356) and control returns to step 344 to wait for the next scan pulse input.

The jump takeoff position indicator system as herein described provides a device that solves the problems associated with the prior art while meeting all the objectives set forth at the beginning of the specification. The novel system design has allowed inexpensive IR LEDS and sensors meant for indoor use to be used reliably in an outdoor environment while providing an accurate indication of the takeoff point of an athlete competing in a Track & Field jumping event.

It should be noted that it is within the scope of this invention that other types of indicia, such as liquid crystal based displays may be used in place of the LED indicators for display of the takeoff position. It should also be noted that while the present invention uses multiple microcontrollers to form a modular system, it is obvious that a single microcontroller or several could be used as the basis for the system. It should be understood that I wish to include within these claims all such minor changes and modifications that might be proposed by those skilled in the art.

I claim:

1. A method of detecting the position of a foot during a jump takeoff, comprising the steps of:

(a) providing a plurality of light beams;

(b) providing a plurality of light detectors for sensing said plurality of light beams;

(c) enabling at least one light beam at a time of said plurality of light beams, enabling at least one light detector corresponding to said at least one light beam;

(d) storing the presence or absence of each of said plurality of light beams in a memory:

(e) indicating the presence or absence of each one of said plurality of light beams;

(f) recalling said presence or absence of each of said plurality of light beams from said by a recall switch activation; and (g) displaying the position of said foot during said jump takeoff.

2. The method of detecting the position of a foot during a jump takeoff of claim 1, further comprising the step of:

collimating each one of said plurality of light beams, collimating each one of said plurality of light detectors.

3. The method of detecting the position of a foot during a jump takeoff of claim 2, further comprising the step of:

collimating each one of said plurality of light beams and light detectors by placing an aperture in front of each one of said plurality of light beams and light detectors.

4. The method of detecting the position of a foot during a jump takeoff of claim 1, further comprising the step of:

enabling said plurality of light beams and said plurality of light detectors sequentially.

5. A jump takeoff position indicator system for detecting and displaying the foot position of an athlete when starling a jump, comprising;

(a) an infrared light beam emitting device for emitting a plurality of infrared light beams;

(b) an infrared light beam detecting device for detecting the presence of said plurality of infrared light beams;

(c) a collimating means for collimating the emission and detection of said plurality of infrared light beams;

(d) a synchronization means for synchronizing the emission of said plurality of infrared light beams with the detection of said light beams by said infrared light beam detecting device;

(e) a display means for displaying the presence or absence of said plurality of infrared light beams;

(f) a memory for storing the status of said plurality of infrared light beams at the moment of takeoff; and (g) a recall switch for recalling and displaying said status on said display means;

whereby the foot position at jump takeoff is stored and displayed at the desired time.

6. Said jump takeoff position indicator system of claim 5 in which both said light beam emitting assembly and said light beam detecting assembly contain a microprocessor that enables and synchronizes said plurality of infrared light emitting device and said plurality of infrared light detecting devices to operate in a single emitter and detector pair; whereby said jump takeoff position indicator system is battery-powered.

7. A jump takeoff position indicator system comprising:

(a) a light beam emitting assembly containing a plurality of infrared light emitting devices for emitting a plurality of infrared light beams;

(b) a light beam detecting assembly containing a plurality of infrared light detecting devices for detecting the presence of said plurality of infrared light beams;

(c) a collimating means for collimating one of said infrared light emitting devices to one of said infrared light detecting devices;

(d) a storage means for electronically storing the absence of one or more of said plurality of infrared light beams; and (e) a display means for displaying the absence of one or more of said plurality of infrared light beams; whereby said jump takeoff position indicator system configured to detect, store, hold, and display the position of an athlete's foot at the moment of takeoff.

* * * * *